73-651
6/19/84 XR 4,455,461

United States Patent [19]
Maguire

[11] 4,455,461
[45] Jun. 19, 1984

[54] ADJUSTABLE IMBALANCE DETECTOR FOR A CENTRIFUGE

[75] Inventor: Stephen A. Maguire, Waterbury, Conn.

[73] Assignee: E. I. DuPont de Nemours and Company, Wilmington, Del.

[21] Appl. No.: 427,419

[22] Filed: Sep. 29, 1982

[51] Int. Cl.³ ..... H01H 35/14
[52] U.S. Cl. ..... 200/61.45 R; 73/651; 73/660; 200/61.48; 200/61.51
[58] Field of Search ..... 200/61.45 R, 61.48, 200/61.51; 340/683; 73/462, 660, 651, 654; 494/7, 8, 10

[56] References Cited

U.S. PATENT DOCUMENTS

| | | | |
|---|---|---|---|
| 2,311,855 | 2/1943 | Nelson | 200/61.51 |
| 2,895,023 | 7/1959 | Blum | 200/61.45 R |
| 2,974,521 | 3/1961 | Phelps | 200/61.48 |
| 3,226,016 | 12/1965 | Couper et al. | 200/61.45 R |
| 3,333,073 | 7/1967 | Ohlson | 200/61.45 R |
| 4,099,667 | 7/1978 | Uchida | 494/7 |

*Primary Examiner*—James J. Gill
*Assistant Examiner*—John E. Chapman, Jr.

[57] ABSTRACT

An imbalance detector for a centrifuge includes a pendulum arm that is tuned to a critical frequency that lies within a predetermined range of the critical frequency of the rotor of the centrifuge. An imbalance force imposed by the rotor is transmitted to the detector and if the imbalance force exceeds a predetermined threshold the arm contacts an electrical contact to generate an appropriate electrical signal.

5 Claims, 2 Drawing Figures

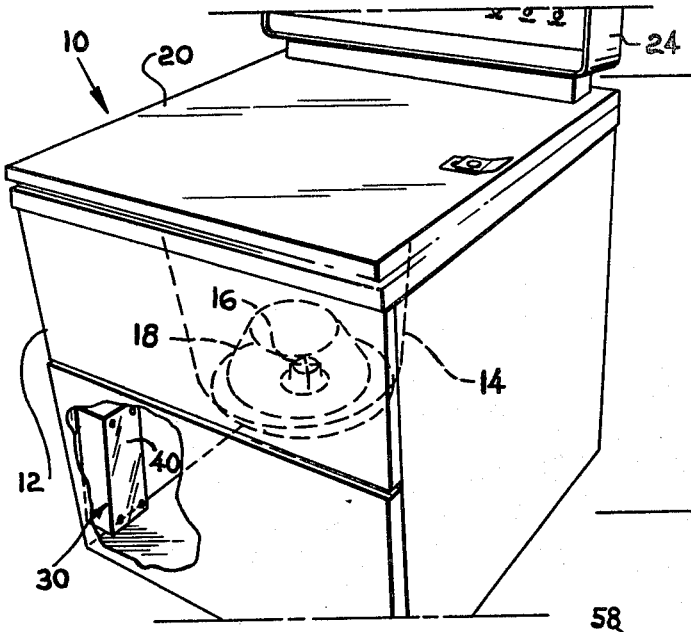
Fig. 1
Fig. 2
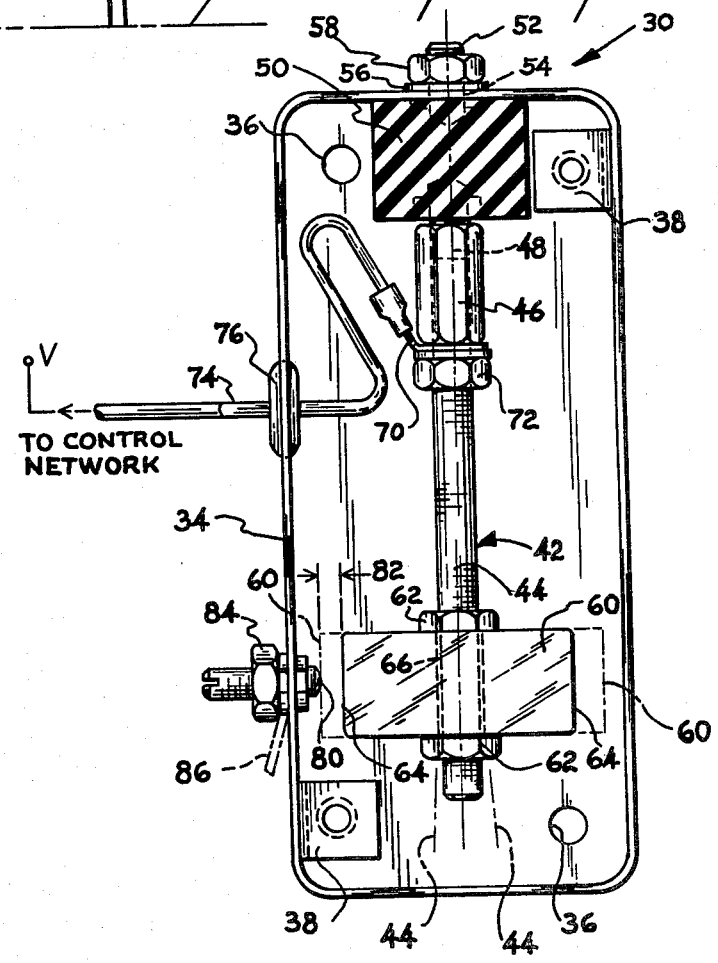

ADJUSTABLE IMBALANCE DETECTOR FOR A CENTRIFUGE

BACKGROUND OF THE INVENTION

This invention relates to an imbalance detector for a centrifuge and, in particular, to an imbalance detector that is able to be tuned to correspond to the critical frequency of the rotor and rotor drive of the centrifuge with which it is associated.

A centrifuge is an apparatus adapted to subject a sample of a material to a centrifugal force field in order to separate that sample into its constituent components. For example, a common use for a centrifuge is in a bloodbank where whole blood received from donors is separated by centrifugal force into its red cell and plasma components. The centrifuge includes a rotating member, or rotor, mounted for rotational movement within a stationary casing. The rotor may be outfitted with buckets or cavities which carry the material to be separated during the period of exposure to the centrifugal force field. While the rotor is operating it is vital to be able to detect force imbalances which may be imposed upon the rotor. Such imbalances may occur, for example, as a result of unbalanced positioning of the load in the rotor. If left unchecked, the imbalancing forces may result in premature failure of the centrifuge drive.

Like any dynamic element the rotor has associated with it a critical frequency corresponding to a critical rotating speed through which the rotor must pass when moving from rest to its operating speed. The critical frequency and hence the critical speed of a particular rotor is dependent upon the physical configuration of the rotor as well as the stiffness of the rotor drive. It is at the critical speed that any imbalances in the rotor tend to cause maximum vibrational amplitudes of the rotor. Due to the self-centering flexible nature of the drive imbalance forces at critical speed are likely to be significantly greater than the imbalance forces imposed on the centrifuge while at its operating speed. Accordingly, if the imbalance forces imposed by a rotor on the centrifuge during its transit through its critical speed are below a predetermined threshold, it is likely that imbalances imposed at its operating speed will also remain below that threshold.

It is believed advantageous to provide a rotor imbalance detector for a centrifuge which is tuned to exhibit its critical frequency at or about the critical frequency of the centrifuge rotor. Thus, the imbalance detector is arranged to be responsive to the imbalance forces which are imposed by the rotor on the centrifuge through the drive while the rotor is at its critical speed and to generate a safety signal resulting in the occurrence of preventive action if the imbalance forces exceed a predetermined threshold.

SUMMARY OF THE INVENTION

This invention relates to an imbalance detector for a centrifuge which is tuned to respond at a predetermined critical frequency at or within a predetermined range of the critical frequency of the centrifuge rotor used in the centrifuge. The detector is adapted to be responsive to an imbalance force imposed by the rotor on the centrifuge at the rotor's corresponding critical speed and to generate a safety signal if the magnitude of the imbalance force exceeds a predetermined threshold.

The imbalance detector in accordance with the present invention includes a housing physically attachable to the casing of the centrifuge and having a pendulum arm mounted therewithin. The arm has a plumb having a predetermined weight disposed thereon a predetermined distance from the attachment of the arm to the housing. The weight of the plumb, the stiffness of the arm and the distance from the point of attachment are adjustably selectable to tune the arm and impart to it a critical frequency that lies within a predetermined range of the critical frequency of the rotor. An electrical contact element is mounted to the housing and is spaced a predetermined distance from the plumb on the arm. The pendulum arm responds to an imbalance force imposed by the rotor, transmitted through the centrifuge drive to the casing and the housing and imposed on the arm by swinging through the predetermined distance to touch the plumb to the electrical contact element to generate an electrical safety signal if the magnitude of the rotor imbalance force exceeds a predetermined threshold. Preferably, the critical frequency of the detector, and specifically the arm therein, is selected to lie within a predetermined range of the critical frequency of each rotor usable in the centrifuge.

BRIEF DESCRIPTION OF THE DRAWINGS

The invention will be more fully understood from the following detailed description thereof taken in connection with the accompanying drawings which form a part of this application and in which:

FIG. 1 is perspective view of a centrifuge apparatus having a portion of its outer casing removed to illustrate the mounting of an imbalance detector in accordance with the present invention; and FIG. 2 is an elevation view of an imbalance detector in accordance with the present invention with the cover thereof removed for clarity.

DETAILED DESCRIPTION OF THE INVENTION

Throughout the following detailed description similar reference numerals refer to similar elements in all figures of the drawings.

In FIG. 1 shown is a perspective view of a centrifuge apparatus generally indicated by reference character 10. The centrifuge 10 includes a casing 12 having a chamber 14 formed therewithin. A centrifuge drive 16 projecting into the chamber 14 receives a rotating member or rotor 18 thereon. Although FIG. 1 depicts the rotor 18 as being of the fixed angle type it is to be understood that the rotor may be either a swinging bucket or a fixed angle rotor depending upon the nature of the material to be separated. Access to the chamber 14 for the insertion of the rotor 18 thereinto and the loading of the same with the material to be separated is afforded through a door 20 hingedly connected to the top of the centrifuge 12, all in accordance with the art.

The motive force for rotation of the rotor 18 is derived from a suitable drive motor (not shown) mounted in the lower portion of the casing 12. A control network is provided which responds to separation process parameter limits selected by the operator through a control panel 24 mounted to the top of the casing 12. A brake (not shown) is suitably connected to the motor and is responsive to the control network to slow and to stop the rotation of the rotor 18 at the end of the operating run or in the event of a safety condition.

In accordance with this invention an imbalance detector generally indicated by reference character 30 is mounted to the casing 12 in a predetermined location as indicated in the cutaway portion of FIG. 1. Imbalance forces imposed by the rotor 18 manifest themselves in vibrations which are transmitted to the casing 12 through the drive and which are detectable by the imbalance detector 30. The detector 30 is itself tuned to exhibit its critical frequency at or near the critical frequency of the rotor 18 used in the centrifuge 12. Thus, if the magnitude of the imbalance force imposed by the rotor 18 while the rotor 18 is at the critical speed corresponding to its critical frequency exceeds the predetermined threshold the imbalance detector 30 is operative to transmit a signal representative of this fact over a line connected to the control network thus resulting in the braking of the rotor 18.

Shown in FIG. 2 is an elevation view of the imbalance detector 30 in accordance with the present invention. The detector 30 includes a housing 34 fabricated of a suitable material such as sheet metal or plastic. The housing 34 is secured to the casing 12 of the centrifuge 10 by suitable bolts or the like extending through apertures 36 provided on the interior of the housing 34. Mounting pads 38 are provided to receive the cover 40 (FIG. 1) of the detector 30.

The detector 30 further includes a pendulum arm generally indicated by reference character 42 mounted to the interior of the housing 34. The detector 30 is tuned to respond at a predetermined critical frequency that is at or within a predetermined range of the critical frequency of the rotor used in the centrifuge. In the preferred embodiment this is accomplished by making the critical frequency of the pendulum arm 42 adjustably selectable in a manner to be discussed herein. The pendulum arm 42 includes an elongated threaded rod 44 which is engaged at its upper end to a standoff 46. The standoff 46 in turn receives a threaded stud 48 projecting from a rubber shock mount 50. The shock mount 50 has a second threaded stud 52 projecting from the opposite face thereof. The stud 52 extends upwardly through an opening 54 provided in the housing 34. A lock washer 56 and a nut 58 secure the shock mount 50 to the housing 34.

The lower portion of the threaded rod 44 carries a swinging plumb 60 secured to the rod 44 by upper and lower nuts 62. The plumb 60 is preferably a solid block of stainless steel having a predetermined weight having lateral ends 64. A threaded opening 66 is provided in the plumb 60 through which the rod 44 passes. A conductive collar 70 is electrically connected to the rod 44 and held in position between the standoff 46 by a lock nut 72. An electrical line 74 from the collar 70 exits the housing 34 through an insulated washer 76. The line 74 is connected to the centrifuge control network and in the embodiment shown carries a predetermined electrical potential V.

An electrical contact element, or ground pin, 80 projects into the interior of the housing 34 generally adjacent to one end of the plumb 60. A clearance distance, or gap, 82 is defined between the innermost end of the ground pin 80 and the end 64 of the plumb 60. The distance 82 may be adjustably selectable by means of a threaded lock nut 84 mounted in a position accessible from the exterior of the detector 30. In the embodiment shown, a metal housing 34 is used and the contact 80 is thus at ground potential. If a plastic housing is used a connection 86 (shown in dashed lines) may be provided to connect the contact 80 to ground potential.

The natural frequency of the pendulum arm 42 is adjustably selectable due to the weight of the plumb 60, the stiffness of the rubber shock mount 50 as well as the distance from the shock mount along the length of the rod 44 to the plumb 60. As a result, the amplitude and frequency of the harmonic motion of the pendulum arm 42 may be limited by judicious selection of these parameters. By such judicious selection the critical frequency of the detector 30 may be selected to be at or near the critical frequency of the rotor 18 used in the centrifuge 10. Thus the detector 30 is tuned to be responsive to imbalance forces imposed by the rotor 18 on the centrifuge at the rotor's critical speed. If an imbalance force imposed by the rotor 18 and transmitted through the drive to the casing and the housing exceeds a predetermined threshold, the amplitude of the motion of the pendulum arm is sufficient to bridge the gap 82 between the end 64 of the plumb 60 and the ground pin 82 thus placing the line 74 to the control network at ground potential. In this embodiment of the invention grounding the line 74 serves to generate a safety signal to the control network. Of course, any suitable expedient may be used to generate an appropriate safety signal when the plumb 60 touches the contact 82 and remain within the contemplation of this invention.

In practice, the critical frequency of the detector 30 is selected so as to fall near to the critical frequencies of most, if not all, of the rotors 18 usable within the centrifuge 10. Thus, although the detector 30 is not precisely tuned to correspond to the critical frequency of each rotor used, it is still tuned to within a sufficiently close range that any excessive imbalance force imposed by each rotor on the centrifuge while that rotor is generally at its critical frequency may be detected.

Those skilled in the art, having the benefit of the teachings hereinabove set forth may effect numerous modifications thereto. These modifications are to be construed as lying within the scope of this invention, as defined by the appended claims.

What is claimed is:

1. An imbalance detector for a centrifuge having a casing in which a rotor is mounted for rotational movement, the rotor having a critical speed associated therewith, the detector comprising:

a housing mounted to the casing;

a pendulum arm attached to the housing, the arm having a plumb of a predetermined weight disposed thereon a predetermined distance from the attachment of the arm to the housing, the weight of the plumb, the stiffness of the arm and the distance from the point of attachment being adjustable to tune the arm and impart to it a critical frequency that lies within a predetermined range of the critical frequency of the rotor; and an electrical contact element mounted to the housing and spaced on the arm a predetermined distance from the plumb, the pendulum arm responding to an imbalance force imposed by the rotor and transmitted through the casing and the housing to the arm by swinging through the predetermined distance to touch the plumb to the electrical contact to generate an electrical safety signal if the magnitude of the rotor imbalance force exceeds a predetermined threshold.

2. The detector of claim 1 wherein the arm is mounted to the housing through a shock mount which imparts the predetermined stiffness to the arm.

3. The detector of claims 1 or 2 wherein the arm is threaded over a portion thereof and the plumb is a solid block having a threaded bore adapted to threadedly receive the arm, the distance between the arm of the arm to the housing being adjustable by the threaded engagement of the plumb to the arm.

4. The detector of claims 1 or 2 wherein the arm is connected to a source of electrical potential and the contact is at ground potential such that when the plumb contacts the arm the arm is grounded to thereby generate the safety signal.

5. The detector of claim 3 wherein the arm is connected to a source of electrical potential and the contact is at ground potential such that when the plumb contacts the arm the arm is grounded to thereby generate the safety signal.

* * * * *